United States Patent [19]

Quinn et al.

[11] Patent Number: 4,756,642

[45] Date of Patent: Jul. 12, 1988

[54] BOAT STORAGE, SHIPPING SYSTEM AND SUPPORT THEREFORE

[75] Inventors: Russell C. Quinn, Twinsburg; Frank B. Robb, Willoughby, both of Ohio

[73] Assignee: Jos. Dyson & Sons, Inc., Painesville, Ohio

[21] Appl. No.: 27,899

[22] Filed: Mar. 19, 1987

[51] Int. Cl.[4] ..... B63C 1/00

[52] U.S. Cl. ..... 405/7; 114/44; 248/354.1; 280/414.1; 405/3

[58] Field of Search ..... 405/7, 3, 1; 114/44; 269/296; 280/414.1; 248/354.1, 560, 637

[56] References Cited

U.S. PATENT DOCUMENTS

| | | | |
|---|---|---|---|
| 3,139,277 | 6/1964 | Mears | 405/7 X |
| 4,155,667 | 5/1979 | Ebsen | 405/7 |
| 4,468,150 | 8/1984 | Price | 405/7 |

FOREIGN PATENT DOCUMENTS

| | | | |
|---|---|---|---|
| 1082680 | 3/1984 | U.S.S.R. | 405/7 |

*Primary Examiner*—Dennis L. Taylor
*Attorney, Agent, or Firm*—Frank B. Robb

[57] ABSTRACT

A system for storage and shipping of boats availing of a series of adjustable support units which are connected by flexible elements to each other to prevent lateral and longitudinal movement of the boat with respect to its supported location, the support units likewise providing for fastening of a boat to the units by other flexible elements.

9 Claims, 2 Drawing Sheets

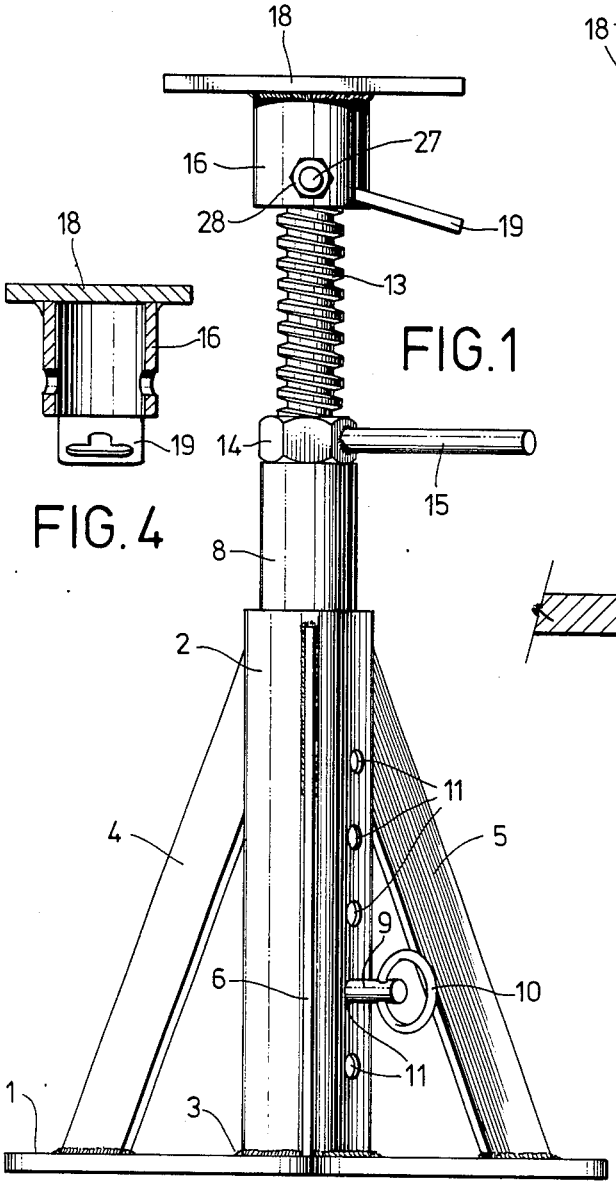
FIG. 1
FIG. 4
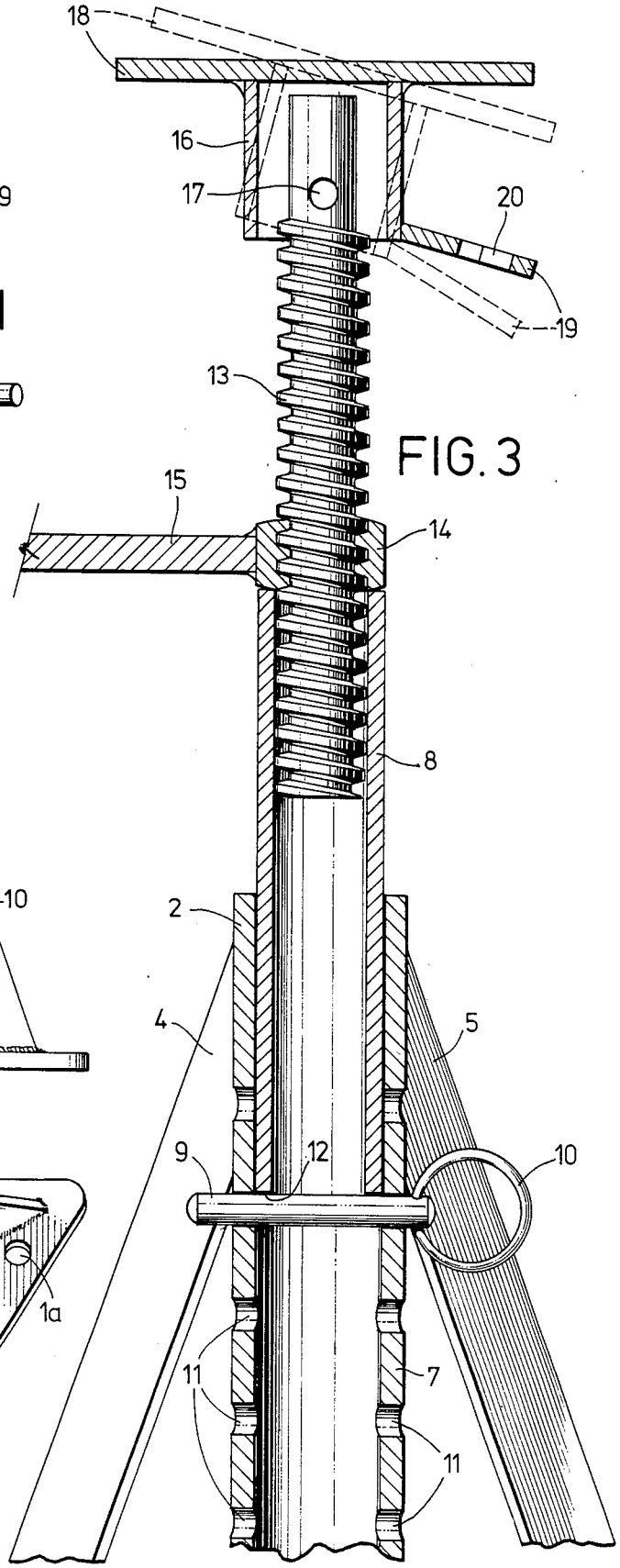
FIG. 3
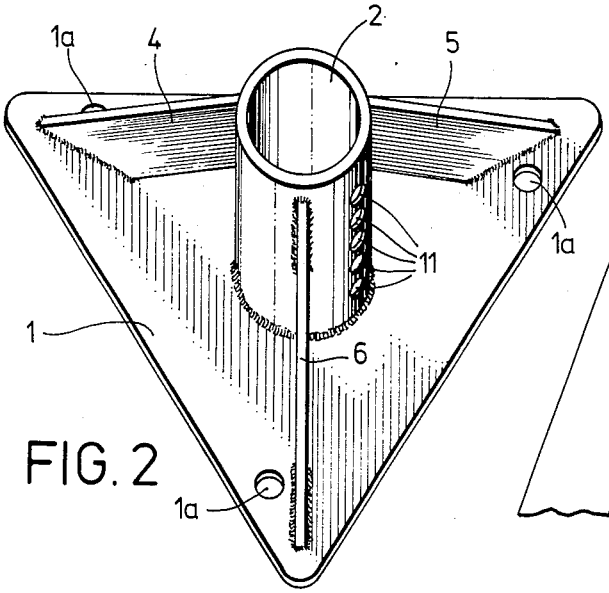
FIG. 2

BOAT STORAGE, SHIPPING SYSTEM AND SUPPORT THEREFORE

BACKGROUND OF THE INVENTION

Storage and shipment of boats in sizes ranging from eighteen feet to about thirty-two feet more or less, is most often effected by placing the boat in a cradle which is suitable for either use, such cradle usually being of wood and of heavy construction.

This results in several problems, not the least of which is handling of the cradle itself, when the boat is not in place thereon, both to move it into and out of storage location, but further interfering with bottom painting or repair because of the structural parts of such cradle units which are often quite heavy and thus require lift equipment for that purpose.

While there have been proposed various kinds of stands of one kind or another though we are not aware of any prior patented devices for boat storage, it is highly desirable to provide for boat shipping and storage, using the same basic elements if possible with a simple adjustable arrangement for flexible, safe use and handling of any means which are availed of for the purposes outlined hereinbefore. Relative light weight of parts for such a purpose is also obviously desirable and compactness of any means for use in both storage and shipping is a prime consideration.

GENERAL DESCRIPTION OF THE INVENTION

With the foregoing background in mind, the instant invention makes provision for all the desirable attributes with few if any drawbacks, by availing of relatively simple parts which nevertheless acting together, furnish safe simple storage and shipping of boats.

First of all, the elements comprising this invention are a series of support units which are basically identical, are relatively light in weight and portable, strong enough whereby a series of the same properly positioned will be adjustable to support boats of widely varying bottom contours. Adjustments of the boat contacting portions of the units not only provide safe positioning both laterally and longitudinally, but in combination with certain flexible elements which interconnect the units, prevent undesirable movement of the boat in storage, provided by tensioning action, which the units can provide, but also in shipping, facilitate fastening of the boat to a moving support to safely permit such movement.

The flexible elements themselves may be of different forms and material such as steel strapping, cable, or even strong webbing.

The foregoing set forth the broad aspects of the instant concept and the details will be described hereinafter in conjunction with the drawings wherein:

FIG. 1 is a side elevational view of a support unit constituting a basic element hereof.

FIG. 2 is a top plan view with portions removed to disclose the base shape of the support unit.

FIG. 3 is a fragmentary vertical sectional view of the center post assembly of a support unit.

FIG. 4 is a fragmentary view partly in section to illustrate a position of the pad mount.

DETAILED DESCRIPTION OF THE INVENTION

Figure 5:
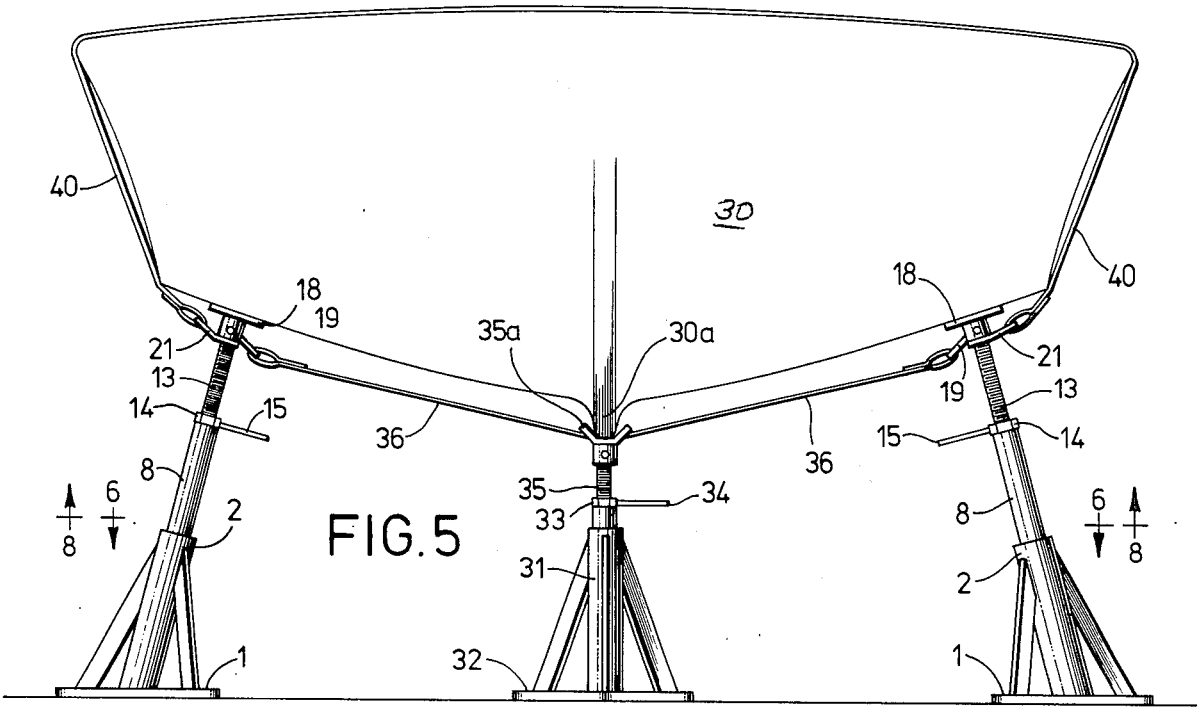
FIG. 5 is a somewhat diagrammatic view to illustrate the preferred arrangement of a series of supporting units and the lateral interconnection thereof in position beneath a boat hull for storage or shipping.

Referring to FIG. 1, wherein a complete individual support unit is disclosed, there is shown a base 1 which is triangular in shape as viewed in FIG. 2, and from which extends upwardly a center post assembly generally denoted 2, to be described in greater detail subsequently, said center post assembly in turn being arranged to have a slight angular relationship with the base 1 as suggested primarily in FIG. 5 for example, the post assembly being connected by welding to the base at 3 and suitable brace members 4, 5 and 6 being supplied and suitably fastened both at the upper and lower ends to the main post unit and base 1 as will be observed.

The main post unit 2, is shown in greater detail in FIG. 3 as comprising an outer fixed main post 7 of tubular form, which is fastened at 3 as indicated in FIG. 1, and includes a secondary adjustable tube 8 telescopically arranged within the tube 7, so as to be movable upwardly and downwardly and adjustably maintained in position within that member 7 by means of a support pin 9 which includes a ring 10 fastened thereto to facilitate withdrawal of the pin 9 from openings such as are disclosed at 11 and there being a series of these in which the pin may be inserted and upon which the secondary adjustable tube 8 may rest at its end as suggested in FIG. 3 at 12 this being the lower end as will be readily understood.

Supported within this secondary adjustable tube 8, is an adjusting screw 13 which is of suitable strong form and provided with a square cut thread on its periphery which thread in turn is arranged to receive a nut 14 from which a handle 15 extends, the handle 15 being welded or otherwise secured to the nut in any preferred manner.

The nut itself is intended to rest upon the upper end of the inner or secondary adjustable tube 8 as will be seen and in turn arranged to position the screw 13 at any desired perpendicular location for the purposes hereof.

At the upper end of the screw 13, there is provided a pad mount 16 which is connected by a pivot 17 to the end of the screw 13 and in such a manner to permit tilting of the pad mount in any reasonable position such as suggested in FIG. 3 by the dotted line disclosure of the pad 18 in that figure.

The pad mount 16 is equipped with a tang 19 extending from the lower portion thereof at an anqle as suggested in FIG. 3, the tang 19, further being equipped with a suitable opening 20 to receive a flexible cable or other connecting device as will be subsequently explained.

Figure 9:
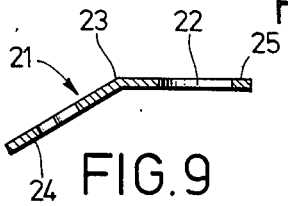
FIG. 9 is a sectional view of a connector part.
Figure 10:
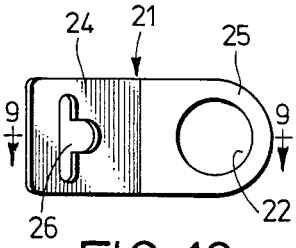
FIG. 10 is a plan view of the part of FIG. 9.

There is also provided a connector designated 21 and shown in FIGS. 9 and 10 , which connector 21 is provided with an opening 22 of such a size as to be mounted on the screw 13. The connector 21 is bent at 23 so as to have the end 24 at an angle with regard to the end 25 for purposes which will appear subsequently, the end 24 having an opening 26 therein similar to the opening 20 of the tang 19 previously mentioned.

As will be observed from FIG. 1, the pad mount 16 is shown as though pivot 17 comprises a bolt indicated at 27 in FIG. 1 and a nut 28 provided therefore to maintain the pad mount in its connected relation with upper end of the screw 13 as seen in FIG. 3.

It is noted that the base 1 initially mentioned may preferably have some bolt holes such as 1*a* therein for purposes which will appear at this time in relation to use of the structure just described in detail.

Figure 6:
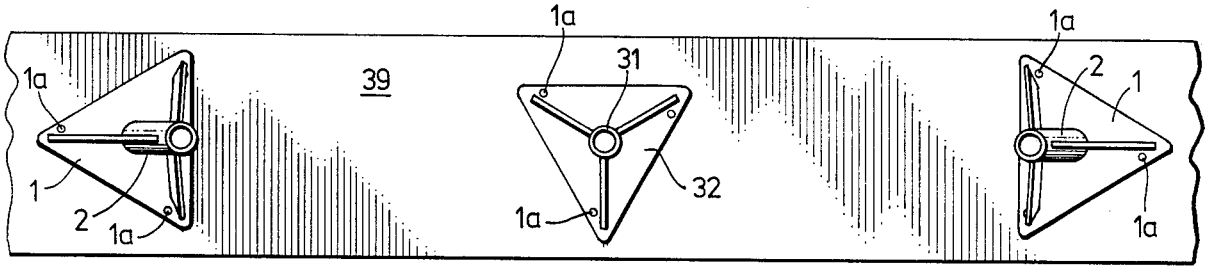
FIG. 6 is a fragmentary top view taken about on the lines 6—6 of FIG. 5 looking in the direction of the arrows.
Figure 7:
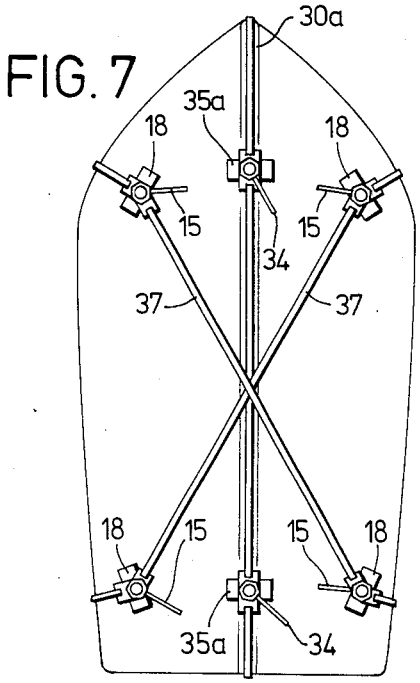
FIG. 7 is a view looking upward about on the line 7—7 of FIG. 5 in the direction of the arrows.

For the purpose of describing this structure, and in disclosing an important aspect of the invention, FIGS. 5 and 6 are referred to, wherein a boat such as indicated at 30 in the front elevation and of any preferred configuration is shown as being supported by the support units hereof, there being a further support unit generally denoted 31 of slightly different form but embodying all of the elements hereof as previously described in detail the difference primarily residing in the angular relationship of the center post assembly 7 initially mentioned which in this case corresponds to the center post of the device 31 and vertically arranged with regard to the base 32 thereof being otherwise equipped with similar instrumentalities which are adjustable including a nut 33 operated by a handle 34 to raise and lower the screw 35 and in turn a pad 35*a* to support the keel of the boat which is denoted 30*a* and may be of any other form but that chosen being illustrative.

Turning now to a more detailed description of the outer or side support units, which are identical as suggested and designated 2 in each case, being angularly arranged so that the upward pressure of the pads 18 at the upper ends of the screws 13 thereof will properly adapt and connect with and support the boat 30 in a suitable balanced condition, again referring to FIG. 1.

As seen in that figure, the pad unit or mount 16, the tang 19 thereof being connected in this instance by a cable 36 which extends from and beneath the bottom of the boat 30 and beneath the keel 30*a* thereof and thence to the other opposite support unit 2 being similarly connected to the tang 19 of an identical mount 16 and sufficiently tensioned to initially prevent the cable 36 from sagging for example.

It will be understood that the pad 18 is initially spaced slightly from the bottom of the boat so that when the cable 36 is connected to the boat pad mount 16, subsequent rotation of the nut 14 on each of the units will cause the cable 30 to be increasingly tensioned and thereby further assure that the pads 18 will be uniformly engaging with the bottom as is desirable.

Obviously both nuts 14 will have to be operated to tension the cable 30 but by so doing uniform pressure may be exerted.

Figure 8:
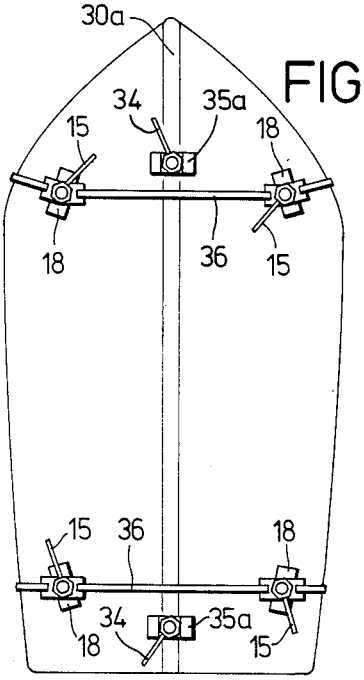
FIG. 8 is a view similar to FIG. 7, fragmentary in nature, to illustrate a modified form of interconnection of the support units.

This is illustrated from beneath by the disclosure of FIG. 8 wherein the cable 36 extends transversely of the hull of the boat.

Under some conditions and under one desirable arrangement, it may be preferred that cables such as 37 are connected diagonally to diagonally positioned support units, will, by the tensioning arrangement previously described, sufficiently maintain the boat against lateral as well as longitudinal movement in the storage condition.

Since it is desirable under many conditions to ship a boat with some kind of support over land for example on a flat bed or a suitable trailer, it is also contemplated by this invention that provisions for that circumstance be made and to that end FIG. 6 is referred to as disclosing support units, two at each side, and a center support unit 31 suitably fastened to a tranversely extending heavy plank or board denoted 39 with the units being fastened there to so that all are movable at once and a similar arrangement may be supplied for as many places longitudinally of the boat as are deemed necessary for suitable support in transport.

Thereafter the cable such as 37 may be used and the cables 36 also if desired, and in addition in order to maintain the boat on and in contact position against the mounts and specifically pads 18 thereof, a suitable strap 40 may be availed of which is connected as shown in FIG. 5 to the portion 24 of a connector 21 previously described, in this case connector 21 being turned so that the portion 24 thereof extends upwardly and thus permits the strap 40 to be connected to the opening 26 of the connector, thence up, over and around the hull of the boat down the other side of the same. Thus by suitable tensioning of the strap 40 the boat may be maintained in position on and in contact with the respective support units on which it is positioned.

It will thus be seen that in effect a suitable cradle arrangement has been provided and of course the transversely extending planks or boards 39 may be in turn fastened to the flat bed of a trailer or the like for transportation of the boat or if necessary to maintain the same in suitable position for storage purposes, all to the end of making that the most simple and accessible arrangement possible.

We claim:

1. A boat storage and shipping system comprising a series of upright individual support units, each having a stable base and an adjustable pad member at the upper end of each said unit, a boat having a keel, and supported on said members, said boat having varying contours at bottom and sides of same, and normally flexible tensionable elements connecting the support units with each other and sufficiently tightened adjacent the bottom and keel to prevent longitudinal and lateral movement of the boat with respect to said units.

2. A system as claimed in claim 1, wherein the pad members engage the bottom of the boat in predetermined positions, the elements extend laterally and longitudinally of the boat, said elements being connected to the support units and following the contours of the boat bottom to prevent relative movement of the units with respect to each other and the boat.

3. A system as claimed in claim 1, wherein the pad members engage the bottom of the boat in predetermined positions, the elements extend laterally and longitudinally of the boat following the contours of said bottom, said elements being connected to the support units to prevent relative movement of the units with respect to each other and the boat, said support units including means to tension the elements.

4. A system as claimed in claim 1, wherein the pad members engage the bottom of the boat in predetermined positions, the elements extend laterally and longitudinally of the boat, following the contours of said bottom, said elements being connected to the support units to prevent relative movement of the units with respect to each other and the boat, said support units including means to tension the elements, said means also providing for adjustment of the pad members to determine the attitude of the boat with respect to a surface engaged by the support units.

5. A support unit as claimed in claim 1, wherein the same comprises a base, a main post assembly connected to the base, brace parts fixed to the base and upper portion of the post assembly, a pad mounted on means adjustable with respect to the post assembly, said means further providing for tensioning of the elements at the upper portions of the assembly when they connect a series of support units together.

6. A support unit for boat shipping and storage comprising a flat base, a main post assembly connected to the base, brace parts fixed to the base and assembly to maintain the same in generally upright position, said assembly comprising a main tube, a secondary tube positioned within the main tube for upward and downward adjustment with respect to the main tube, means to maintain the secondary tube in various adjusted positions, an adjusting screw mounted in the secondary tube, an adjusting nut on the screw to position the same with respect to the secondary tube, a pad for engagement with a boat bottom pivotally connected to the screw, means carried by the screw for connection to flexible elements to in turn connect one support unit with another support unit in boat supporting position.

7. A support unit as claimed in claim 6, wherein means are carried by the screw for connection to flexible elements to in turn connect one support unit with another support unit in boat supporting position.

8. A unit as claimed in claim 6, wherein the pad is connected to the screw by a pivotal mount, said mount having a tang to be engaged by a flexible element, adjustment of the screw to assist in positioning a boat likewise effecting tensioning action of the flexible element aforesaid.

9. A unit as claimed in claim 8, wherein a connector part is mounted on the screw for connection to a flexible element which is arranged to maintain a boat in position with a series of support units.

* * * * *